US010221656B2

(12) United States Patent
Barton et al.

(10) Patent No.: US 10,221,656 B2
(45) Date of Patent: Mar. 5, 2019

(54) METHOD AND APPARATUS FOR STIMULATING MULTIPLE INTERVALS

(71) Applicant: SageRider, Incorporated, Rosharon, TX (US)

(72) Inventors: Ryan Barton, Richmond, TX (US); Tyler Wall, Richmond, TX (US); Stephen Lee Jackson, Eureka Springs, AR (US); Ledif Basanta, Missouri City, TX (US)

(73) Assignee: Sagerider, Incorporated, Rosharon, TX (US)

( * ) Notice: Subject to any disclaimer, the term of this patent is extended or adjusted under 35 U.S.C. 154(b) by 614 days.

(21) Appl. No.: 14/579,278

(22) Filed: Dec. 22, 2014

(65) Prior Publication Data

US 2016/0177670 A1 Jun. 23, 2016

Related U.S. Application Data

(60) Provisional application No. 61/922,523, filed on Dec. 31, 2013.

(51) Int. Cl.

| | |
|---|---|
| ***E21B 34/10*** | (2006.01) |
| ***E21B 43/14*** | (2006.01) |
| ***E21B 34/14*** | (2006.01) |
| ***E21B 43/26*** | (2006.01) |
| *E21B 34/00* | (2006.01) |

(52) U.S. Cl.

CPC ..... *E21B 34/14* (2013.01); *E21B 34/10* (2013.01); *E21B 43/14* (2013.01); *E21B 43/26* (2013.01); *E21B 2034/007* (2013.01)

(58) Field of Classification Search

CPC ..... E21B 34/10; E21B 43/14; E21B 2034/007

See application file for complete search history.

(56) References Cited

U.S. PATENT DOCUMENTS

| | | | | |
|---|---|---|---|---|
| 3,780,809 | A * | 12/1973 | Ayers, Jr. | E21B 34/108 137/624.11 |
| 4,791,991 | A * | 12/1988 | Morris | E21B 34/10 166/319 |
| 4,915,168 | A | 4/1990 | Upchurch | |
| 4,945,995 | A | 8/1990 | Tholance | |
| 5,293,551 | A * | 3/1994 | Perkins | E21B 34/066 251/129.01 |
| 5,465,787 | A * | 11/1995 | Roth | E21B 21/103 166/319 |
| 6,470,970 | B1 * | 10/2002 | Purkis | E21B 23/04 166/319 |
| 6,536,530 | B2 | 3/2003 | Schultz | |

(Continued)

OTHER PUBLICATIONS

PCT/US14/72540 International Search Report dated Mar. 20, 2015.

*Primary Examiner* — Kipp C Wallace
(74) *Attorney, Agent, or Firm* — McAfee & Taft

(57) ABSTRACT

A system and process relating to well fracturing and stimulation operations are provided. The system and process allow for fracturing multiple zones in a wellbore. The system and process provide for introducing a fluid through a plurality of spaced-apart sleeve assemblies wherein each sleeve assembly can be in an operable state which allows the sleeve assembly to be open or closed and can be in a non-operable state which prevents the sleeve assembly from opening or closing.

21 Claims, 10 Drawing Sheets

(56) References Cited

U.S. PATENT DOCUMENTS

| | | | | |
|---|---|---|---|---|
| 7,337,850 | B2 * | 3/2008 | Contant | E21B 23/04 166/375 |
| 8,188,881 | B2 | 5/2012 | Mandrou | |
| 9,051,826 | B2 * | 6/2015 | Shaw | E21B 34/10 |
| 2004/0050555 | A1 * | 3/2004 | Rayssiguier | E21B 23/04 166/374 |
| 2006/0124310 | A1 * | 6/2006 | Lopez de Cardenas | E21B 34/06 166/313 |
| 2007/0261861 | A1 * | 11/2007 | MacDougall | E21B 34/10 166/381 |
| 2009/0218102 | A1 | 9/2009 | Casciaro | |
| 2009/0223670 | A1 | 10/2009 | Snider | |
| 2010/0038092 | A1 * | 2/2010 | Powell | E21B 34/10 166/375 |
| 2010/0175868 | A1 * | 7/2010 | Wright | E21B 34/10 166/66.4 |
| 2010/0200243 | A1 | 8/2010 | Perkis | |
| 2011/0210609 | A1 * | 9/2011 | Smithson | E21B 23/00 307/38 |
| 2012/0267119 | A1 * | 10/2012 | Patel | E21B 34/10 166/373 |
| 2013/0056220 | A1 * | 3/2013 | Sommers | E21B 34/102 166/373 |

* cited by examiner

METHOD AND APPARATUS FOR STIMULATING MULTIPLE INTERVALS

CROSS-REFERENCE TO RELATED APPLICATION

This application claims the benefit of U.S. Provisional Application No. 61/922,523 filed Dec. 31, 2013, which is hereby incorporated by reference.

FIELD

This invention relates to downhole tools and more specifically relates to downhole tools used in well fracturing and stimulation processes.

BACKGROUND

Wellbores drilled for the production of hydrocarbons therefrom may be drilled in generally vertical, deviated or lateral/horizontal orientations. Such wellbores may penetrate one or more formations or zones from which hydrocarbons may be produced. It is a regular practice once a well is drilled to stimulate the zones to be produced from to increase production therefrom. One common form of stimulation is called fracturing or fracking. Fracturing a well involves pumping a fracturing or frac fluid into the zone. The frac fluid will generally include proppants. When the fracturing fluid along with the proppant is pumped into the zone and pump rates are thereafter reduced, the crack or fracture cannot close because the proppant keeps the cracks open. The cracks or fractures provide a permeable path to connect the producing wellbore with the zone. While there are a number of methods and systems devised for fracturing multiple zones and for producing hydrocarbons therefrom, there continues to be a need for improved systems and methods from stimulating and producing from multiple zones intersected by a wellbore.

SUMMARY

In one aspect there is provided a system for fracturing multiple zones in a wellbore. The system comprises a plurality of spaced-apart sleeve assemblies, each of which defines a central passage therethrough, the sleeve assemblies being selectively switchable between open and closed positions. In the open position a fluid may be communicated through the sleeve assembly to the exterior of the sleeve assembly. In some embodiments, the system further comprises a controller associated with each of the sleeve assemblies for completing and breaking a hydraulic circuit. When the hydraulic circuit is complete, the sleeve assembly is movable between open and closed positions and, when the hydraulic circuit is broken, the sleeve is not movable between open and closed positions.

In another aspect, there is provided an apparatus for fracturing multiple zones in a well. The apparatus comprises a plurality of tubing-deployed fracturing devices, a first control unit, and a second control unit. The fracturing devices are selectively switchable between open and closed positions. Each fracturing device has a unique address. The first control unit can send a unique signal corresponding to the unique address to move the fracturing device between operable and non-operable states. The second control unit can move the fracturing device between the open and closed positions. When the fracturing device is in the open position a zone intersected by the well may be fractured therethrough.

In yet another aspect, a method of fracturing a plurality of zones in a wellbore is provided, the method comprising:

(a) lowering a plurality of fracturing devices on a tubing into the wellbore so that each of the fracturing devices is adjacent to one of the zones;
(b) sending a signal to one of the fracturing devices to move the fracturing device to an operable mode to thus actuate the fracturing device;
(c) opening the actuated fracturing device;
(d) fracturing the zone adjacent to the actuated fracturing device, the fracturing occurring by pumping fracturing fluid through the first fracturing device;
(e) closing the actuated fracturing device after fracturing fluid is pumped into the first zone; and
(f) repeating steps (a)-(d) for at least one additional of the fracturing devices.

BRIEF DESCRIPTION OF THE DRAWINGS

FIG. 13 is a perspective view of the sliding sleeve assembly with the upper segment of the outer casing removed.

DETAILED DESCRIPTION

As will be used herein, directional terms, such as "above," "below," "upper," "lower," etc., are used for convenience in referring to the accompanying drawings and descriptions thereof. In general, the terms "above," "upper," "upward," and other similar terms refer to a direction toward the earth's surface relative to a wellbore, and the term "below," "lower," "downward" and other similar terms refer to a direction away from the earth's surface relative to a wellbore.

Figure 1:
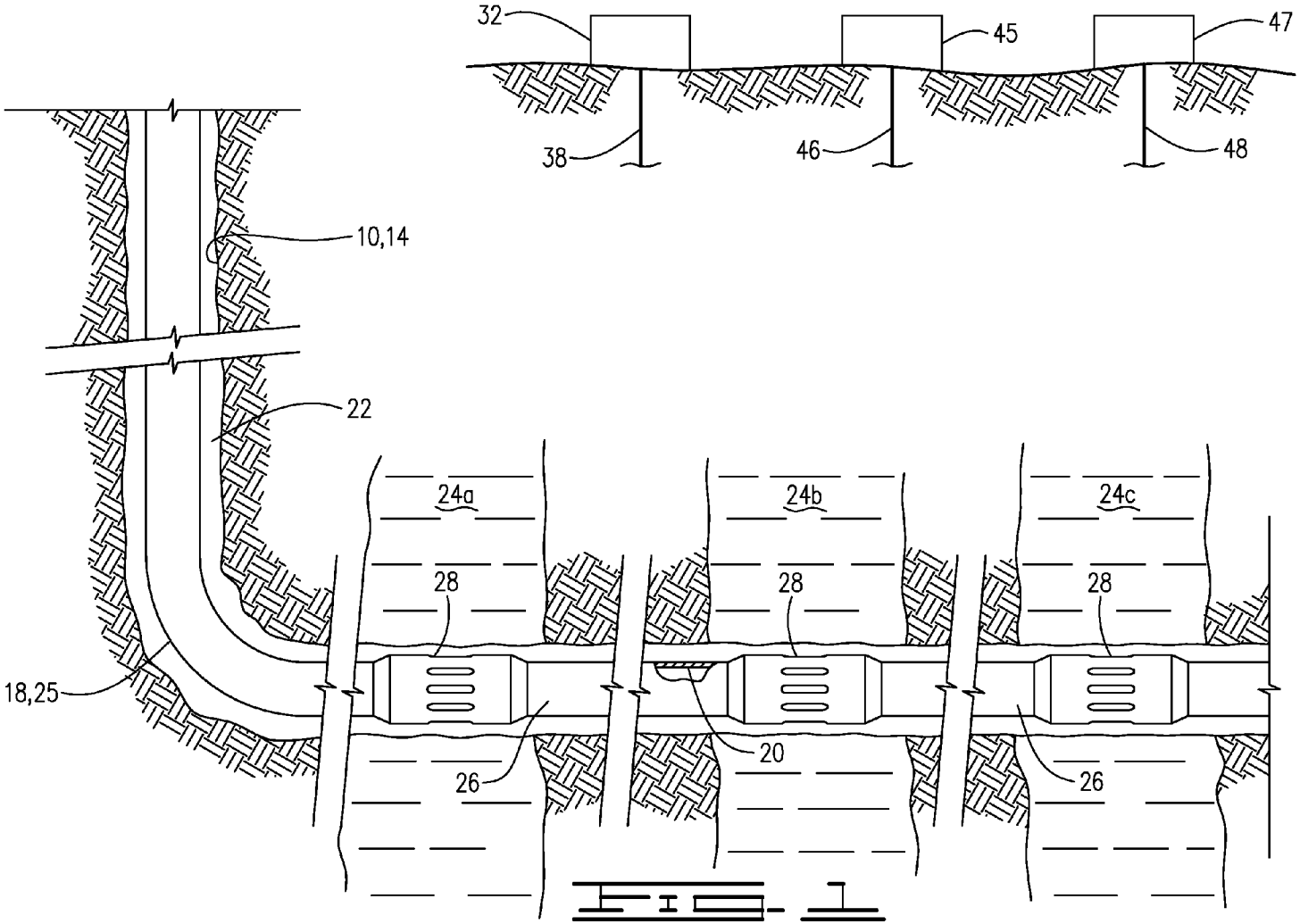
FIG. 1 is a schematic of the apparatus in a well.

Referring now to the figures, FIG. 1 schematically shows well 10 comprising wellbore 14 with apparatus 18 lowered therein. Apparatus 18 defines a central flow passage 20 therethrough. Annulus 22 is defined by apparatus 18 and the wall of wellbore 14. Wellbore 14 may intersect a plurality of zones 24 which as understood in the art may be zones in a single formation or may be zones in separate formations. For ease of reference, the zones shown in the drawing will be referred to as zones 24*a, b* and *c* and it is understood that three is only representative and more or less zones may be intersected by the wellbore 14. Apparatus or system 18 is a pipe string 25 that comprises a plurality of tubulars 26 with a plurality of spaced-apart treating or fracturing devices 28. Pipe string 25 may be referred to as a casing string or tubing string herein. Each fracturing device 28 is an addressable fracturing device with a unique address. Fracturing device 28 is selectively switchable between operable and non-operable and closed positions. Generally, a control box 32 at the surface will send a signal that matches the address of the fracturing device 28 to move the fracturing device 28 from the operable state to the non-operable state.

Control box 32 may be for example a general purpose computer system having software thereon for communicating with instruments downhole, such as fracturing device 28, and any sensors or gauges that may be included and for computing and storing information based on sent and received communications. For example, control box 32 will recognize and store the current state of each fracturing device, the amount of time each is in the operable state, the amount of time needed and used for fracturing and other information, and will record and store the activities conducted. Control box 32 may also be used to gather downhole parameters and other information from downhole sensors and gauges to aid in determining the production from one or more of the zones 24.

When fracturing device 28 is in the operable state, it is movable between open and closed positions. As will be explained in more detail hereinbelow, when in the open position fracturing device 28 will communicate with the wellbore 14 and with a desired zone 24. Thus, a zone 24 may be fractured or otherwise treated through fracturing device 28 and fluid from the selected zone 24 may flow into the central flow passage 20 of the apparatus 18 from formation 24. When fracturing device 28 is in the non-operable state, it will be held in the open or closed position, whichever position it was in prior to moving fracturing device 28 to the non-operable state.

Figure 2:
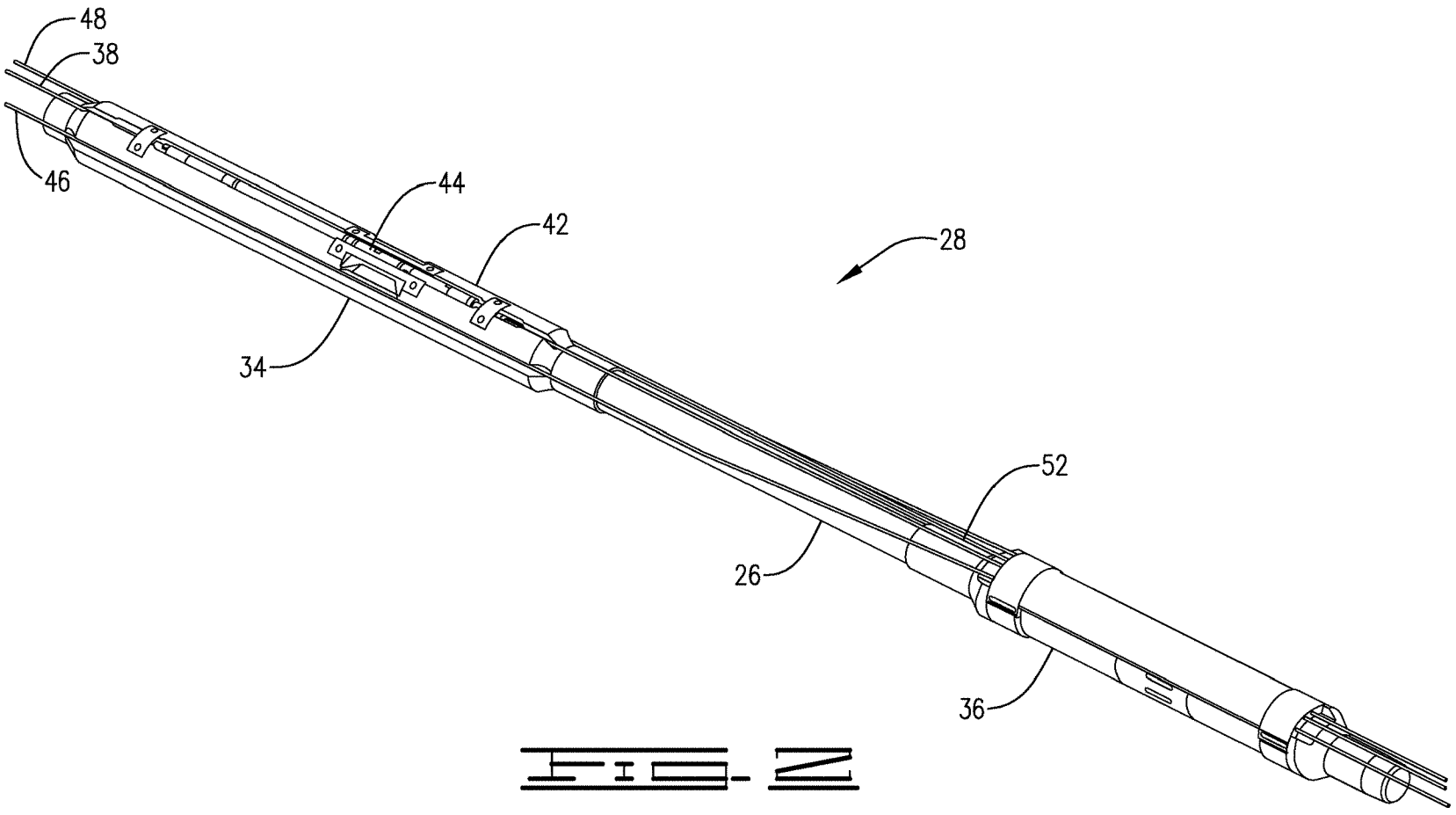
FIG. 2 is a perspective view of a fracturing device of the current disclosure.

With reference to FIG. 2, fracturing devices 28 include a controller 34 and a sliding sleeve assembly or valve assembly 36. Controller 34 and sliding sleeve assembly 36 are connected by a tubular 26. In the described embodiment, controller 34 has a unique address such that when signaled, controller 34 can move between the operable and non-operable states. In the operable state of fracturing device 28, the sliding sleeve assembly 36 may be operated to move between open and closed positions. The operation of fracturing devices 28 will be explained in more detail below.

Returning now to FIG. 1, a tubing encapsulated conductor (TEC) 38 can be connected to control box 32 at the surface. TEC 38 may be used for communicating electrical power and signals to controller 34 for each of the fracturing devices 28. TEC 38 may also power and communicate with any other downhole devices. Fracturing devices 28 define an axial flow passage 58 therethrough (FIG. 7) which comprise a part of the central flow passage 20 of the apparatus 18. As described herein, central flow passage 20 of apparatus 18 is an open bore such that there are no balls, plugs, packers or other devices that would restrict flow or interrupt flow therethrough.

With reference now to both FIGS. 1 and 2, controller 34 comprises a controller carrier 42 and a switch 44, which may be, for example, a solenoid valve. Switch 44 has a unique address, and will receive signals corresponding thereto from control box 32. An increase in current will be noted when solenoid valve 44 is energized, which moves the fracturing device 28 to the operable state. Control box 32 may send a separate signal to de-energize solenoid valve 44, or alternatively, a timer may be utilized so that after a predetermined period solenoid valve 44 is de-energized which will move fracturing device 28 to the non-operable state.

An input or opening line 46 is communicated with a fluid source 45. Opening line 46 defines a flow path to provide hydraulic fluid to each of fracturing devices 28. Likewise, a closing line 48 is shown as connected to fluid source 47, but may be connected to fluid source 45 if desired. Thus, a single input line 46 and single closing line 48 are utilized to provide fluid to all of fracturing devices 28.

Figure 3:
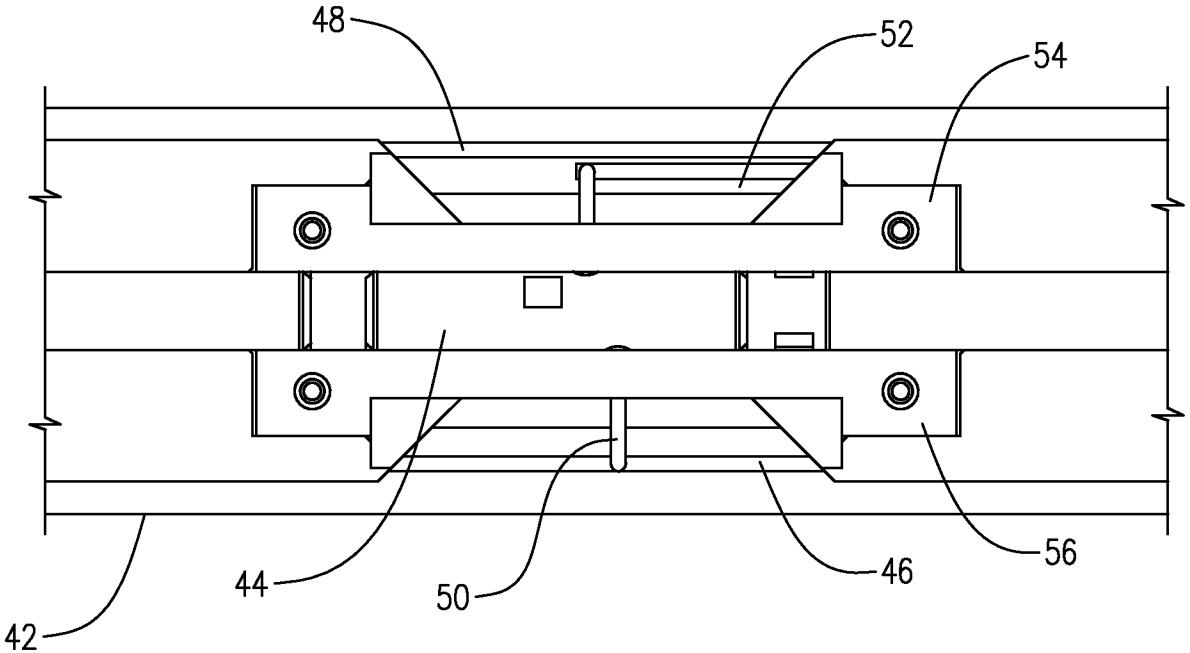
FIG. 3 is a view of a portion of the controller of the disclosure.
Figure 4:
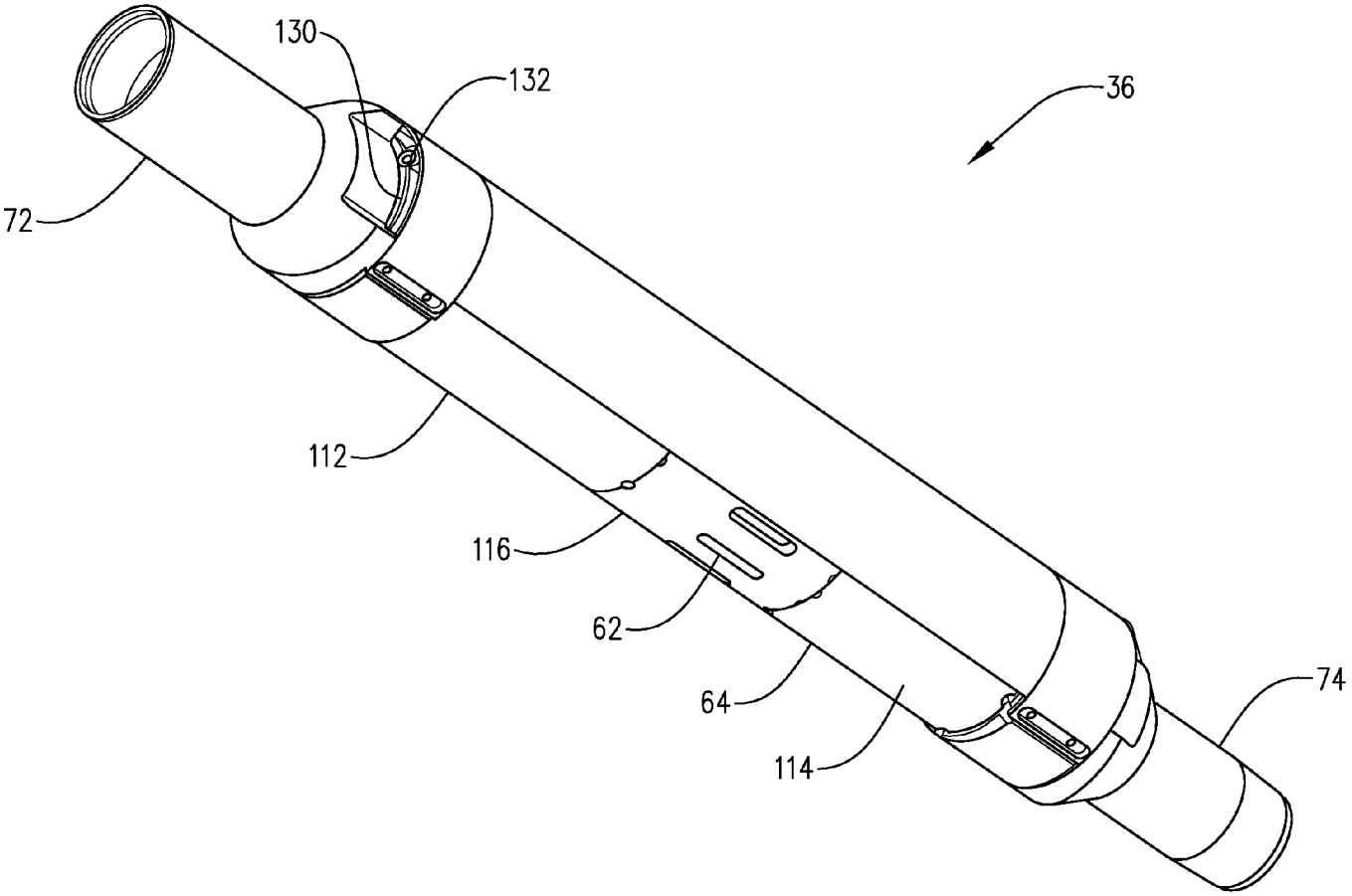
FIG. 4 is an enlarged view of the sliding sleeve assembly of the current disclosure.
Figure 5:
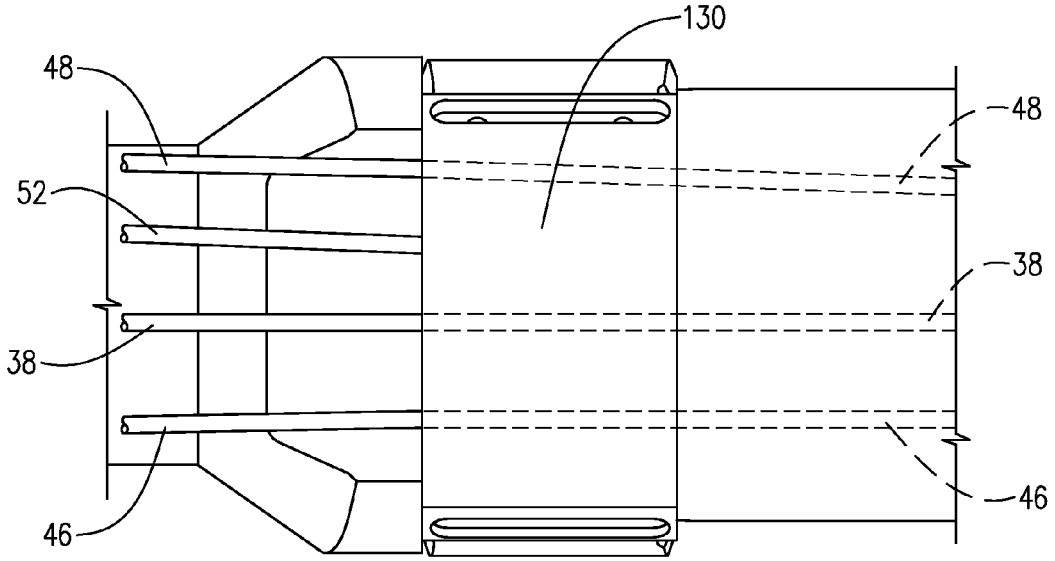
FIGS. 5 and 6 are enlarged views of the upper and lower ends of the sliding sleeve assembly, respectively.

With reference to FIGS. 2 and 3, each fracturing device 28 receives fluid from input line 46 through an inlet branch 50. An inlet tube 52 will communicate fluid from inlet branch 50 to sliding sleeve assembly 36. When the fracturing device 28 is rendered operable by sending a signal to controller 34, fluid may be pumped through input line 46, inlet branch 50 and inlet tube 52 to move sliding sleeve assembly 36 from the closed to the open position. Fluid passes upwardly through closing line 48 as the sliding sleeve assembly moves from the closed to the open position. In the non-operable state, fluid cannot flow through inlet branch 50. Solenoid valve 44 will have the unique address as described herein such that a signal sent to solenoid valve 44 can switch the valve 44 between operable and non-operable states to selectively allow or prevent flow through branch 50 into inlet tube 52. Solenoid valve 44 may be of a type known in the art that will open and/or close a flow path upon the receipt of the signal. Brackets 54 and 56 are utilized to hold TEC 38 and opening line 46, closing line 48 and solenoid valve 44 in place in the controller carrier.

Turning now to FIGS. 4, and 7-11, sleeve assembly 36 defines axial flow passage 58 which comprises a part of central flow passage 20. Sleeve assembly 36 has outer surface or exterior surface 60 and defines at least one and preferably a plurality of ports 62 therethrough. In the closed position of sliding sleeve assembly 36 (FIG. 7), which is the closed position of fracturing device 28, flow through ports 62 from axial flow passage 58 is prevented. In the open position of sleeve assembly 36 (FIG. 9), treating fluid may be communicated through ports 62 from axial flow passage 58 into zone 24 and fluids from the zone 24 may flow therefrom into axial flow passage 58 to be produced to the surface through central flow passage 20 after fracturing is complete.

Sleeve assembly 36 may comprise outer case 64 with upper end or first end 66, and lower or second end 68. An outer or exterior surface 70 of outer case 64 is the same as outer surface 60 of sliding sleeve assembly 36. Ports 62 are defined in outer case 64.

A first or upper coupling 72 is connected, and preferably threadedly connected at upper end 66 to outer case 64. A lower or second coupling 74 is connected and preferably threadedly connected to outer case 64 at the lower end 68 thereof. Both of couplings 72 and 74 are adapted to connect to tubulars 26 in apparatus 18. It is understood that apparatus 18 may be cemented or not cemented in the well as described herein. If apparatus 18 is used in an open, uncemented well, packers or other means known in the art may be used to hold apparatus 18 in wellbore 14.

Sliding sleeve assembly 36 further comprises a mandrel 76 with upper and lower ends 78 and 80, respectively. The upper and lower ends 78 and 80 are connected to couplings 72 and 74, respectively. Mandrel 76 has an inner diameter that defines axial flow passage 82 which defines a part of flow passage 58. Mandrel 76 defines at least one and preferably a plurality of ports 84 therethrough. Ports 84 are in alignment with ports 62. When fracturing device 28 is in the closed position communication between ports 84 and 62 is blocked. Mandrel 76 has an undercut or recess 86 defined in an outer surface 87 thereof, which may provide for ease of manufacture and assembly. Mandrel 76 and outer case 64 define annular space 88 therebetween. Annular space 88 has first or upper end 89 and second or lower end 91. A piston or sliding sleeve 90 with upper end 92 and lower end 94 is disposed and movable in annular space 88. In the closed position of fracturing device 28, upper end 92 abuts upper coupling 72 at upper end 89 of annular space 88. Piston 90 defines a plurality of ports 96 therethrough. A set screw 93 extends from piston 90 into recess 86. Recess 86 has a width sufficient to receive set screw 93 and will prevent rotation of piston 90 as it moves longitudinally in annular space 88. Set screw 93 thus moves with piston 90 and is slidably movable in recess 86.

Piston 90 is slidably disposed in annular space 88. O-rings 100 and 102 on mandrel 76 sealingly engage piston 90. O-rings 100 and 102 are located above and below ports 84 in mandrel 76, respectively. Additional O-rings 104 may be placed at the upper and lower ends of mandrel 76 to seal against upper and lower couplings 72 and 74, respectively. Piston 90 has an O-ring 106 positioned above port 96. Outer case 64 may have O-ring 108 that sealingly engages piston 90. O-rings 110 may be utilized to sealingly engage upper and lower couplings 72 and 74 and may be placed in grooves defined in outer case 64.

Figure 9:
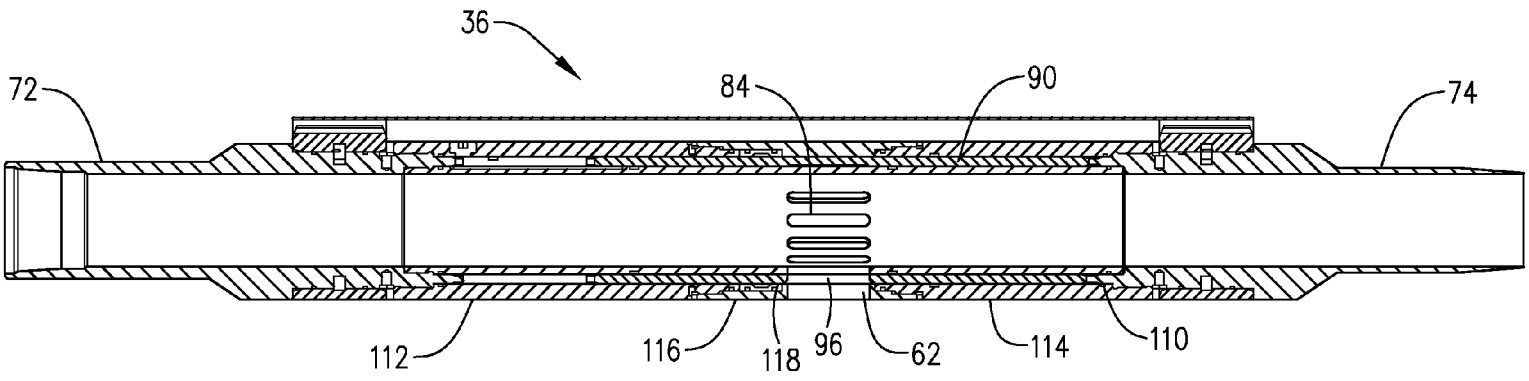
FIG. 9 is a cross-section of the sliding sleeve assembly in the open position.
Figure 10:
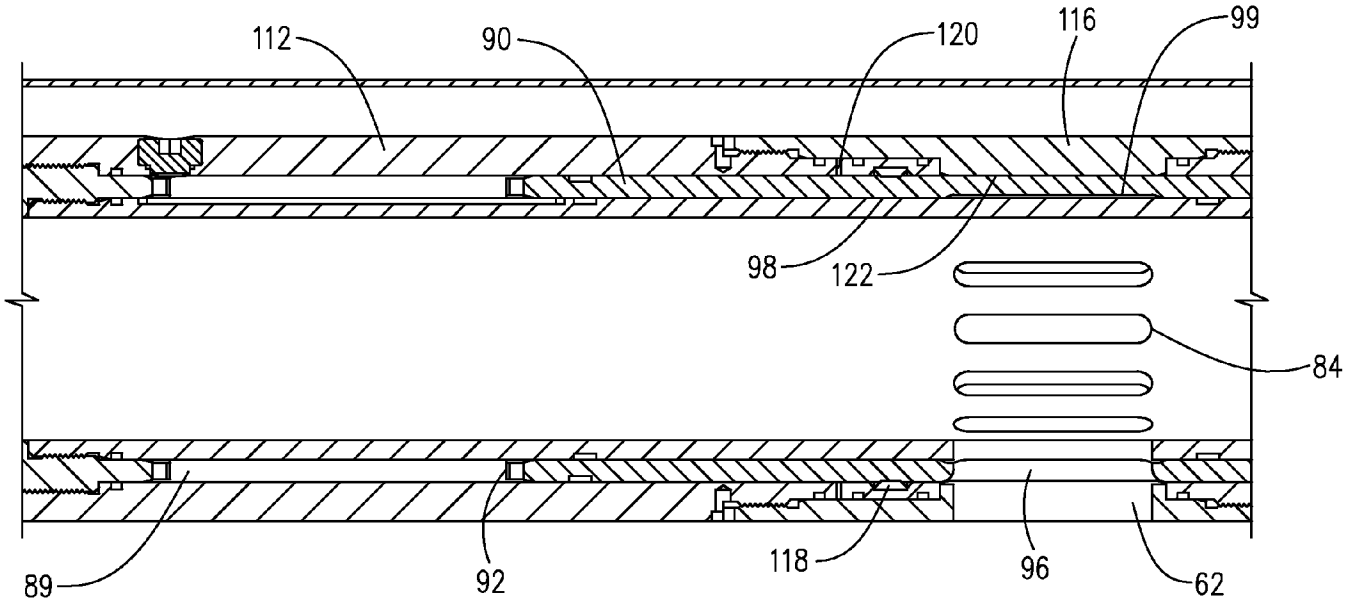
FIGS. 10 and 11 are enlarged views of different portions of the cross-section of FIG. 9.

With reference to FIGS. 9 and 10, outer case 64 may include upper segment 112 and lower segment 114 connected by an insert 116. Ports 62 may be defined in insert 116. A bonded seal 118 may be disposed in an annular space defined by a lower end 120 of upper segment 112 and by a tee portion 122 of the insert 116.

As can best be seen from FIGS. 4, 5, 8, 13 and 14, a first or upper ported fitting 130 is disposed about upper coupling 72. Ported fitting 130 defines a port 132 with first or upper end 134 and second or lower end 136. The second or lower end 136 is plugged to prevent flow therethrough. First end 134 will be connected to the inlet tube 52 to receive fluid therefrom. A space 138, which may be a ring or annular shaped space 138, is defined by a recess 137 in ported fitting 130 and a recess 139 in upper coupling 72. The recesses 137 and 139 are aligned to generate ring-shaped space 138. Fluid is communicated from port 132 into annular space 138 through a passage 141 in fitting 130 and passes from the annular space 138 through at least one passage 142 and preferably a plurality of passageways 142 defined in upper coupling 72 into the annular space 88 in which piston 90 is disposed. In one embodiment, six passageways 142 communicate fluid into annular space 88 to move piston 90.

Figure 14:
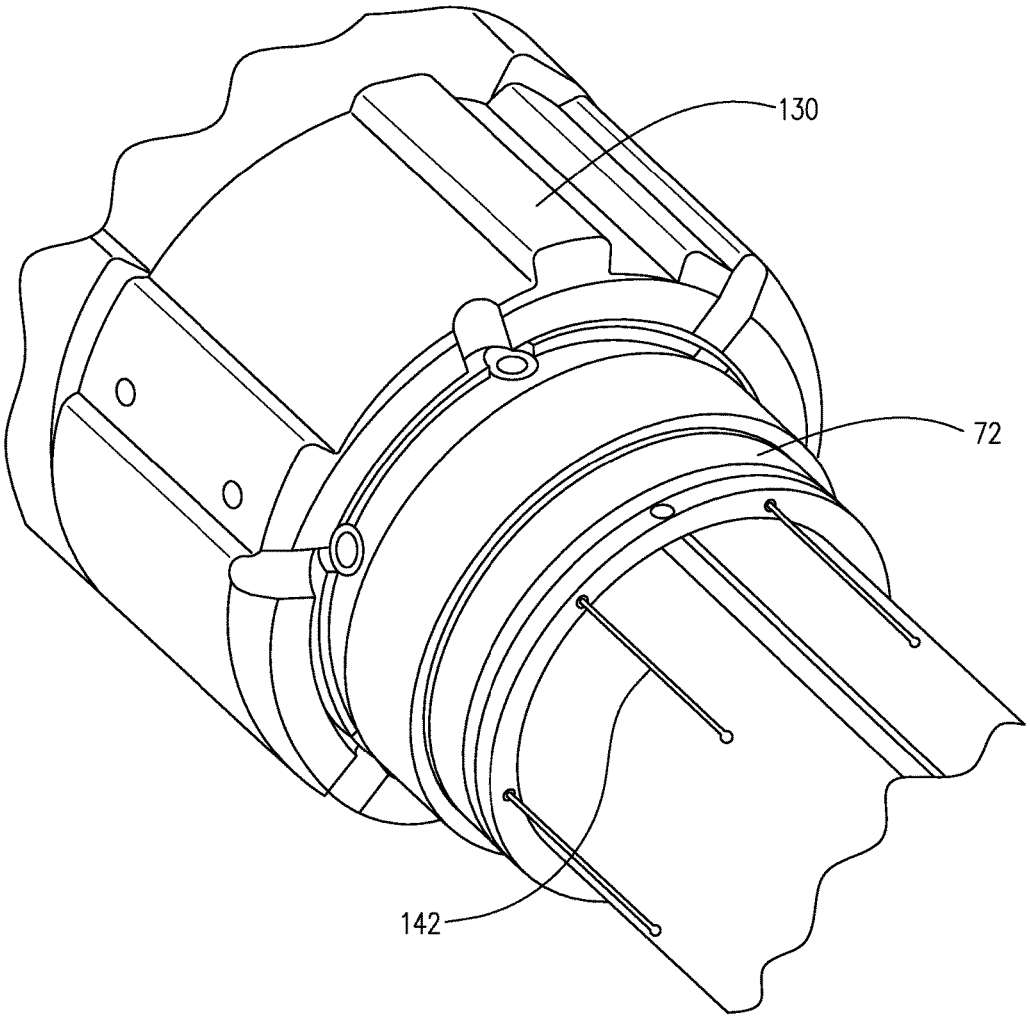
FIG. 14 is an enlargement of a portion of FIG. 13.

Passageways 142 can be seen in FIGS. 13 and 14, wherein the sliding sleeve assembly is illustrated without the upper segment of the outer casing. Passageway 142 can be seen as terminating in the upper end of annular space 88, which in this view is not labeled but is the space between piston 90 and upper coupling 72.

Figure 6:
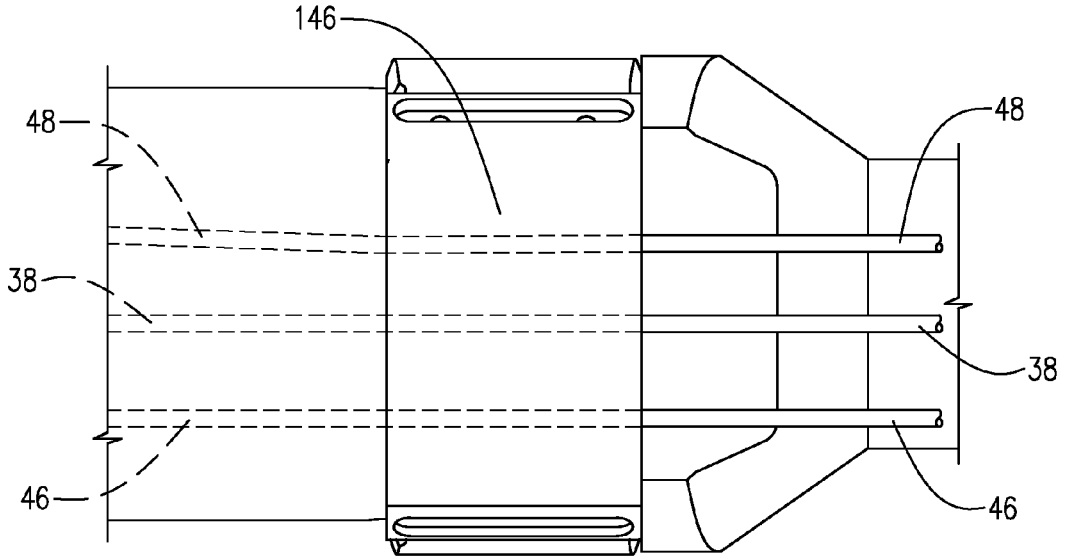
Figure 11:
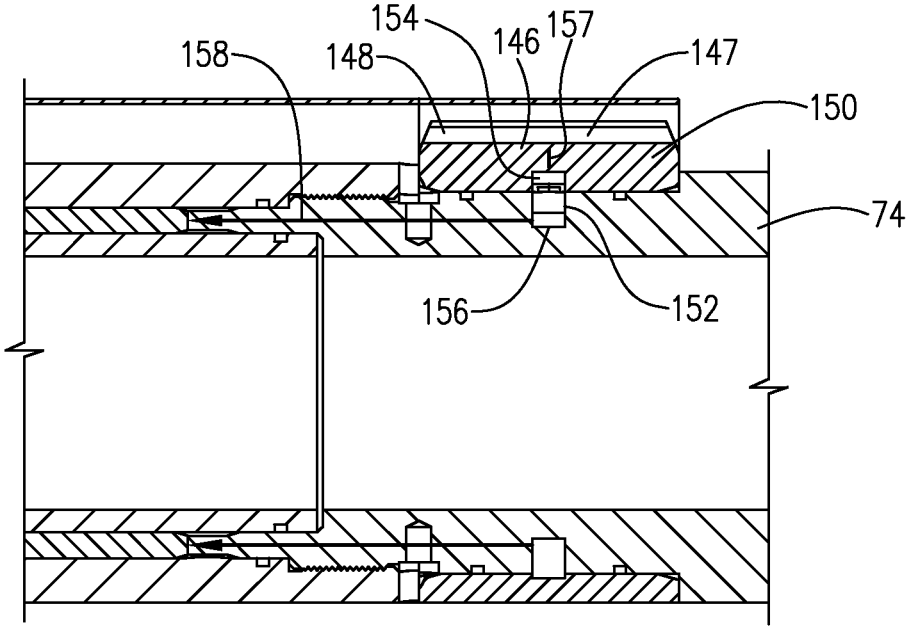

As can best be seen from FIGS. 6 and 11, a second or lower ported fitting 146 is disposed about lower coupling 74 and has a port 147 with an open upper end 148 and an open lower end 150. The open upper end will receive a segment of closing line 48 and the open lower end 150 will likewise receive a segment of the line 48 which will go to the upper end 148 of the ported fitting 146 of the next sliding sleeve assembly 36 therebelow. This will continue for all sliding sleeves 36 except for the final sliding sleeve 36 in apparatus 18. The final sliding sleeve assembly 36 will have a plugged or closed lower end 150.

Figure 12:
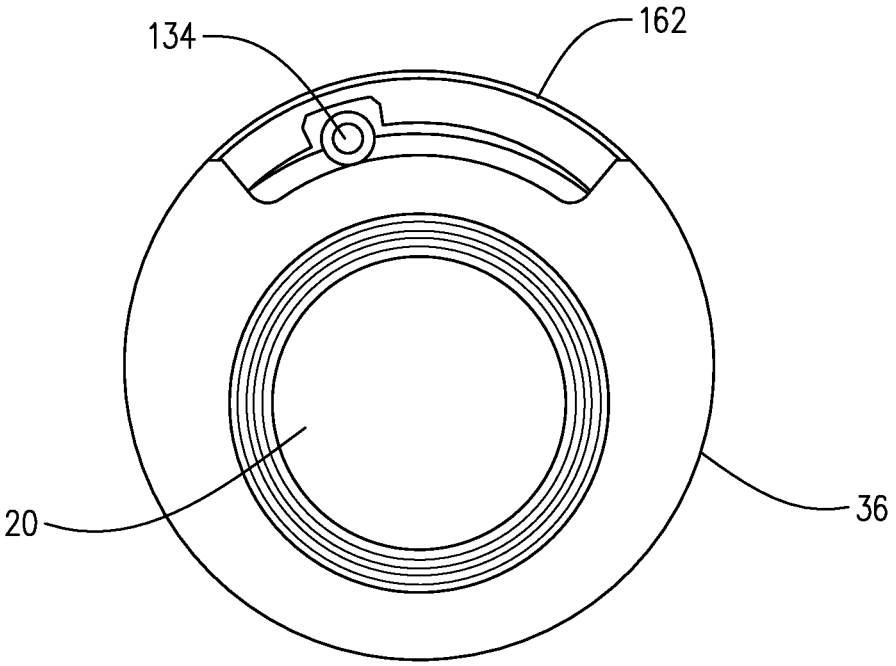
FIG. 12 is an end view of the sliding sleeve assembly.
Figure 15:
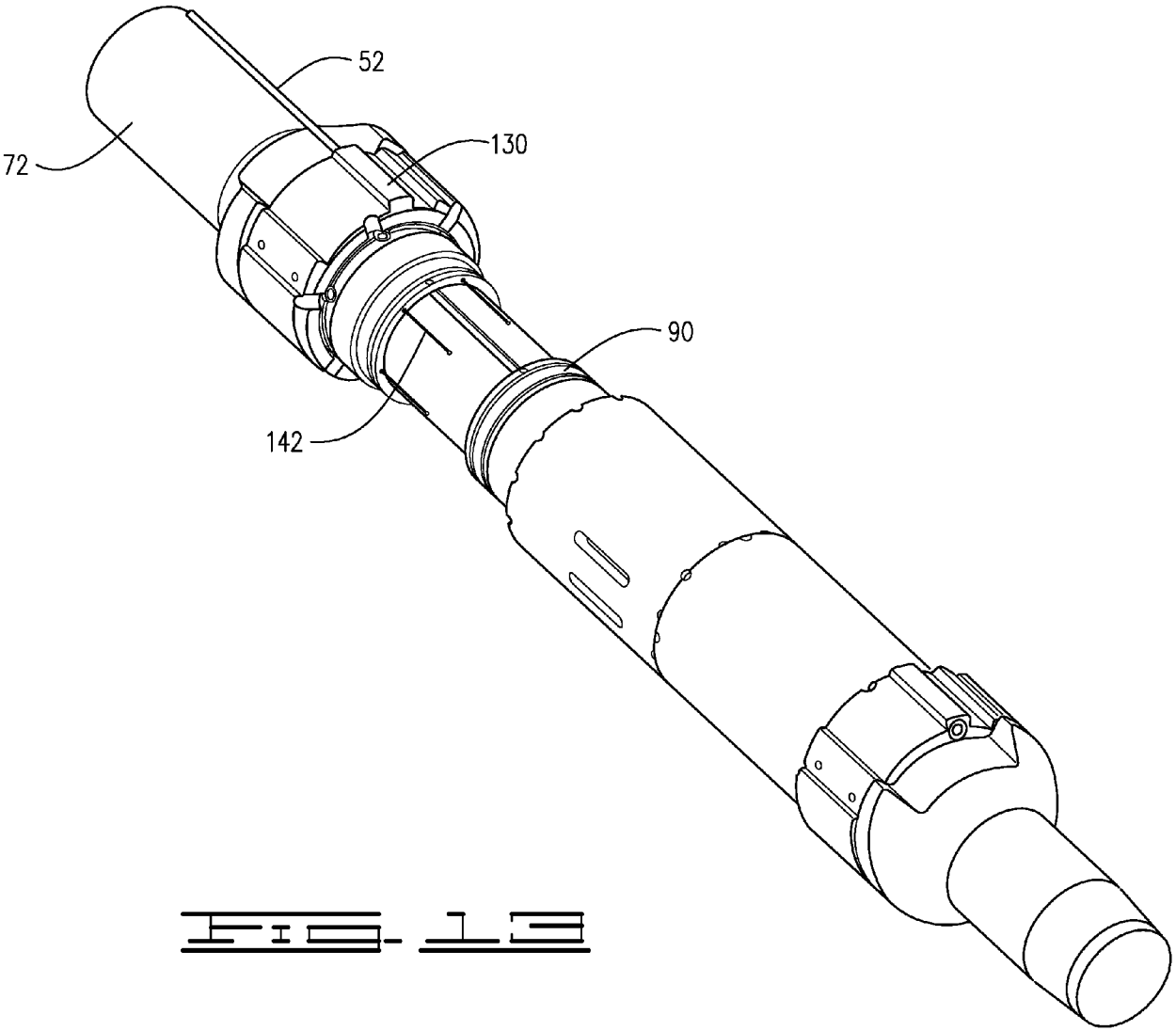

An annular or ring-shaped space 152 is defined by a recess 154 in the inner surface of second ported fitting 146 and an aligned recess 156 in the lower coupling 74. A flow passage 157 communicates fluid from port 147 to annular space 152. A passageway 158, and preferably a plurality of passageways 158 communicate fluid between annular space 152 and annular space 88. In one embodiment six passageways 158 are included. A flow path for each fracturing device 28 may therefore be defined by opening line 46, inlet branch 50, inlet tube 52, port 132, passages 141 and 142, annular space 88, passages 157 and 158, port 147 and closing line 48. Fluid may be supplied by a single source to each of opening and closing lines 46 and 48, such as for example source 45, or may be supplied by separate sources 45 and 47. In either case, the flow path may be referred to as a hydraulic circuit which can be opened/completed or closed/broken by solenoid valve 44 upon receipt of the unique signal that matches the address of the fracturing device 28 to be operated. Passages 141, 142, 157 and 158 are represented by lines in the drawings but it is understood that the lines represent passageways for the communication of fluid therethrough. As can be seen from FIG. 12, a shield 162 may be included to cover the TEC 38, and opening and closing lines 46 and 48, respectively.

In operation, apparatus 18 is lowered into wellbore 14 until fracturing devices 28 are positioned at desired locations in the well. Generally, fracturing devices 28 will be located adjacent zones 24 to be fractured. As described, there may be more or less than the number of fracturing devices 28 and zones 24 than shown in the drawings. Once apparatus 18 is in place, it may be cemented in the wellbore 14 in a manner known in the art although it is understood that apparatus 18 may be used in an open wellbore in which no cementing occurs.

Figure 7:
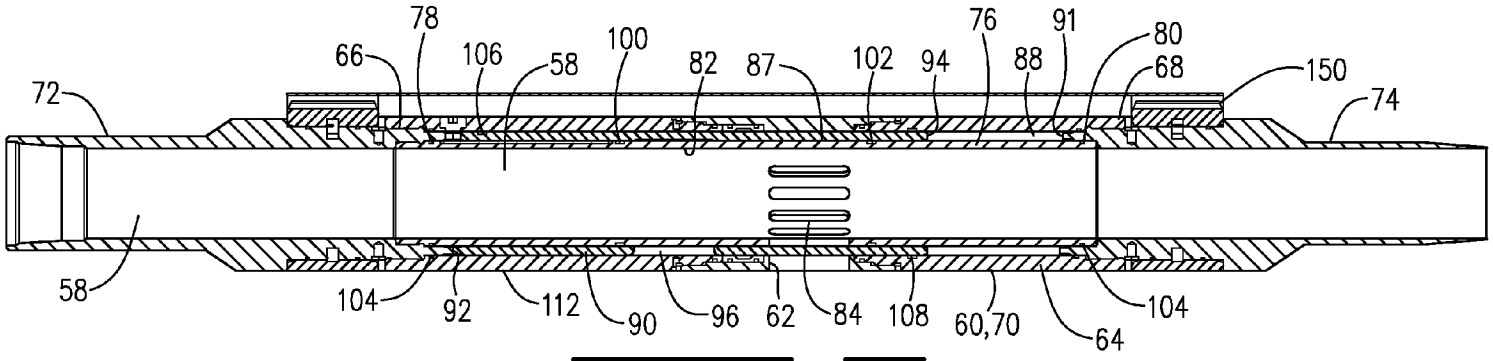
FIG. 7 is a cross-sectional view of the sliding sleeve assembly in a closed position.
Figure 8:
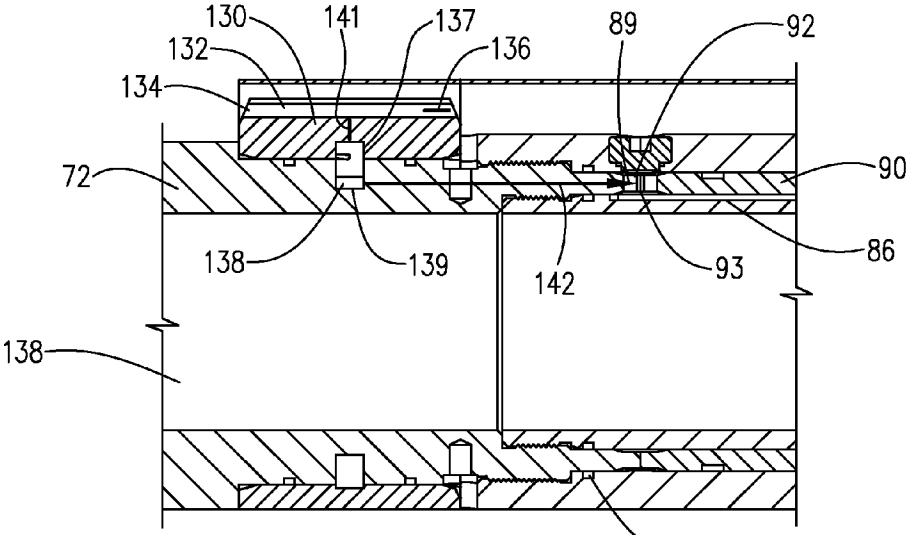
FIG. 8 is an enlarged view of a portion of the cross-section of FIG. 7.

All of the fracturing devices 28 will be in the closed position as apparatus 18 is lowered into the well such that piston 90 will be located as shown in FIG. 7 to block any communication of fluid through port 62. The hydraulic circuit will be fluid filled. After apparatus 18 is properly positioned, fracturing devices 28 may be selectively switched between the open and closed positions. The first fracturing device 28 in apparatus 18 may be moved to the open position and the zone adjacent thereto may be fractured through ports 62. The first fracturing device 28 as described herein is the fracturing device 28 that is the last device 28 to be lowered into the wellbore, in other words the closest in the apparatus 18 to the wellhead. Piston 90 will be moved to align ports 96 with ports 84 in mandrel 76 and ports 62 in outer case 64; thus, piston 90 will be in the open position shown in FIG. 9. When ports 62, 84 and 96 are aligned, treating fluid, such as a fracturing fluid may be communicated therethrough to erode any cement that may be in the well and to fracture the zone 24*a*. Once zone 24*a* is fractured, piston 90 is moved to the closed position shown in FIG. 7 from the open position shown in FIG. 9. The same procedure can be followed with the next or other desired fracturing devices 28. This process can be followed until all or selective ones of the zones 24 have been fractured.

The method for opening and closing fracturing devices 28 includes sending a signal from control box 32 to the fracturing device 28 to be operated. After apparatus 18 is lowered into the well a signal that matches the unique address on the fracturing device 28 to be communicated with is sent to move the fracturing device 28 into the operable state. The signal will energize solenoid valve 44, which opens or completes the hydraulic circuit. An increase in current will be recognized at control box 32, which indicates that solenoid valve 44 is energized and fracturing device 28 is in the operable state. Fluid can be pumped through opening line 46 and inlet branch 50. Fluid will be pumped through inlet tube 52, port 132 and passages 141 and 142 and will engage upper end 92 of piston 90 to urge piston 90 downwardly until ports 62, 84 and 96 are aligned. As piston 90 moves downwardly fluid will be pushed through passages 158 and 157 and into port 147 in second ported fitting 146. Fluid will be pushed upwardly through closing line 48 to the fluid source 47 at the surface or other location. All of the other fracturing devices 28 will be in the non-operable position so that no flow therethrough will be permitted. Once the sliding sleeve assembly 36 is moved to the open position as shown in FIG. 9, solenoid valve 44 on the fracturing device 28 is switched so that fracturing device 28 is in the non-operable state; that is, the solenoid valve 44 is closed, or de-energized, which closes or breaks the hydraulic circuit. Solenoid valve 44 can be de-energized after a predetermined period of time after which it will automatically de-energize, or can be closed with an additional signal to de-energize.

Piston 90 will be held by fluid in the position shown in FIG. 9 which is the open position of the fracturing device and the sliding sleeve assembly 36. Zone 24*a* can then be fractured. Once fracturing is complete, the process is followed again such that a signal is sent to energize solenoid valve 44. To move sliding sleeve assembly 36 from the open to the closed position, fluid pressure is applied through closing line 48. Fluid will flow into port 147 through passages 157 and 158 and will act on the lower end 94 of piston 90 and will push piston 90 upwardly into the closed position. Piston 90 will push fluid through inlet tube 52 and opening line 46 through the passages 141 and 142 as previously described. Solenoid valve 44 may be de-energized automatically after a predetermined period of time, or with an additional signal to break the hydraulic circuit rendering the fracturing device 28 non-operable.

Fluid will prevent piston 90 from moving and will hold piston 90 in the closed position. The same process can be followed with each or selected ones of the plurality of fracturing devices 28 to fracture or otherwise treat all of the selected zones 24. Once the process is complete, the unique signal associated with each can be sent to each fracturing device 28 to move all, or selected ones of the fracturing devices 28 to the open position to allow fluid to flow through the ports 62, 84 and 96 into the central flow passage 20 and upward to the surface. In this manner all of the zones 24 may be produced simultaneously. If desired, only certain of the fracturing devices 28 may be moved to the open position to allow production only from desired zones. The composition of the fluid coming from a particular zone, for example the gas, oil/water composition, can be determined in a manner known in the art such as by taking samples. Flow rates can be determined also. Decisions regarding which of the fracturing devices are to be open or closed may be made based on this information.

The operation described herein may be carried out manually, or software may be programmed to perform all steps. For example, once the apparatus 18 is in place, an operator can cause a signal to be sent to energize solenoid valve 44 for the first fracturing device 28. Fluid will be pumped through opening line 46 to move the fracturing device to the open position. After a predetermined period of time solenoid valve 44 will be de-energized and the fracturing device 28 will be locked in the open position. Fracturing or other treatment processes can then occur. Once the fracturing is complete, which may take several hours, the operator will again cause a signal to be sent to energize solenoid valve 44, and fluid will be pumped through closing line 48 to move fracturing device 28 to the closed position. Solenoid valve 44 is then de-energized to break the hydraulic circuit; thus placing fracturing device 28 in the non-operating state and locking the fracturing device 28 in the closed position.

If desired, control box 32 can be programmed to carry out the steps. In addition, the wellbore operator is provided the opportunity to re-fracture or retreat formations or to treat formations that have not previously been treated during the life of a well. For example, if a well is underproducing or can be produced more efficiently all of the sleeve assemblies can be returned to the closed position. Selected ones of the fracturing devices 28 can be moved to the open position and selected zones can be refractured or retreated. In this manner, production can be increased. In addition, it may be that the apparatus 18 included fracturing devices at locations that were not initially treated, which if conditions change can be opened and additional zones treated as described herein after initial production.

As is clear herein, the fracturing and production will occur through central flow passage 20 which is an open bore with no plugs, balls or packers or any sort of flow restriction therein. Because there is no other opening to a particular zone except for a single fracturing device 28, the need for any isolation devices such as flows, frac balls and packers is eliminated. While the apparatus 18 described herein has a controller 34 associated with each fracturing device 28, a single controller can be used to operate more than one sliding sleeve assembly 36 if desired.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A system for fracturing multiple zones in a wellbore comprising:

a hydraulic input line;

a hydraulic output line;

a plurality of spaced-apart sleeve assemblies, each sleeve assembly defining a central passage therethrough, the sleeve assemblies being selectively switchable between an open position and a closed position, wherein in the open position a fluid may be communicated between the central passage of the sleeve assembly and the exterior of the sleeve assembly, wherein each sleeve assembly comprises:

an outer case;

a mandrel positioned within the outer case so as to define an annular space;

a first coupling connected to a first end of the outer case and a first end of the mandrel;

a second coupling connected to a second end of the outer case and a second end of the mandrel;

a piston disposed in the annular space so as to define a first end of the annular space between the piston and the first coupling, and define a second end of the annular space between the piston and the second coupling, wherein said piston is moveable within the annular space such that movement of the piston determines whether the sleeve assembly is in the open position or the closed position, and wherein the piston is moveable by a fluid such that the sleeve assembly is repeatedly switchable between the open position and the closed position;

a first ported fitting in fluid flow communication with the first end of the annular space through a first plurality of passageways defined on an outer surface of the first coupling;

a second ported fitting in fluid flow communication with the second end of the annular space through a second plurality of passageways defined on an outer surface of the second coupling; and a controller having a switch, the switch being electrically activated to complete an hydraulic circuit such that the first ported fitting is in fluid flow communication with the hydraulic input line and the second ported fitting is in fluid flow communication with the hydraulic output line, and when the switch is not electrically activated the hydraulic circuit is broken, and wherein completion of the hydraulic circuit allows the fluid to move the piston such that the sleeve assembly is switched between the open and closed position; and a tubing encapsulated conductor which transfers an electrical signal between the controller and a control unit at a surface location outside the wellbore, and wherein the switch is activated when the electrical signal matches an address for the controller.

2. The system of claim 1, wherein said control unit is configured to both send said electrical signal and to detect an increase in current indicative of said switch being activated.

3. The system of claim 2, wherein each controller has an address which is unique to that controller, whereupon the controller completes the hydraulic circuit upon receipt of a unique signal that corresponds to the unique address for the controller.

4. The system of claim 2, the system further comprising:

a source of fluid, wherein when the hydraulic circuit is complete, there is fluid flow communication between the source of fluid and the first end of the annular space through the first ported fitting and the first plurality of passageways to move the fracturing device between the open position and the closed position, and wherein fluid flow communication is prevented when the hydraulic circuit is broken.

5. The system of claim 4, wherein the second ported fitting is configured so that, when one of the sleeve assemblies is moved to the open position, fluid flows from the second end of the annular space through the second plurality of passageways to the second ported fitting and, when the fracturing device is moved to the closed position, fluid flows from the second ported fitting through the second plurality of passageways to the second end of the annular space.

6. The system of claim 4, wherein the piston is locked against movement when the hydraulic circuit is broken.

7. The system of claim 1, wherein each sleeve assembly is operable independently of the other of the sleeve assemblies.

8. An apparatus for fracturing multiple zones in a well comprising:

a plurality of tubing-deployed fracturing devices selectively switchable between an open position and a closed position, each fracturing device having a unique address and wherein each fracturing device comprises:

a sleeve assembly comprising an outer case, a mandrel, a first coupling, a second coupling and a piston, wherein the mandrel is positioned within the outer case so as to define an annular space; the first coupling is connected to a first end of the outer case and a first end of the mandrel, the second coupling is connected to a second end of the outer case and a second end of the mandrel, and the piston being disposed in the annular space so as to define a first end of the annular space between the piston and the first coupling, and define a second end of the annular space between the piston and the second coupling;

a first ported fitting in fluid flow communication with the first end of the annular space through a first plurality of passageways defined on a surface of the first coupling;

a second ported fitting in fluid flow communication with the second end of the annular space through a second plurality of passageways defined on a surface of the second coupling;

a first control unit at a surface location outside the wellbore, wherein the first control unit is configured to send the unique electrical signal;

a second control unit having a switch configured to complete and break a hydraulic circuit in response to a unique electrical signal corresponding to the unique address, and thus moving the fracturing device between an operable state and a non-operable state, wherein in the operable state the first ported fitting is in fluid flow communication with a source of fluid, and in the non-operable state the first ported fitting is not in fluid flow communication with the source of fluid and wherein in the operable state the fracturing device is repeatedly moveable between the open and closed positions such that fluid from the source of fluid is introduced into the first end of the annular space through the first ported fitting and the first plurality of passageways to move the fracturing device to the open position, and wherein, when the fracturing device is in the open position, a zone intersected by the well may be fractured therethrough; and a tubing encapsulated conductor which transmits the unique electrical signal between the first control unit and second control unit.

9. The apparatus of claim 8, wherein the piston is movable in the annular space when the hydraulic circuit is complete, and wherein the piston is prevented from moving when the hydraulic circuit is broken.

10. The apparatus of claim 9, wherein the switch has the unique address such that upon receipt of the unique signal the switch will open and close the hydraulic circuit.

11. The apparatus of claim 9, wherein the second ported fitting is configured so that, when the fracturing device is moved to the open position, fluid flows from the second end of the annular space through the second plurality of passageways to the second ported fitting and, when the fracturing device is moved to the closed position, fluid flows from the second ported fitting through the second plurality of passageways to the second end of the annular space.

12. The apparatus of claim 9, the hydraulic circuit comprising:

an opening line in fluid flow communication with the first ported fitting; and a closing line in fluid flow communication with the second ported fitting; and wherein fluid introduced through the opening line moves the piston to the open position, and fluid introduced through the closing line moves the piston to the closed position when the hydraulic circuit is completed.

13. The apparatus of claim 12, further comprising a single opening line for providing fluid to the first ported fitting of each fracturing device.

14. The apparatus of claim 13, further comprising a single closing line for communicating fluid to and from the second ported fitting of each fracturing device.

15. A method of fracturing a plurality of zones in a wellbore comprising:

(a) lowering a plurality of fracturing devices on a tubing into the wellbore so that each of the fracturing devices is adjacent to one of the zones, wherein each fracturing device comprises:

a sleeve assembly comprising an outer case;

a mandrel positioned within the outer case so as to define an annular space;

a first coupling connected to a first end of the outer case and a first end of the mandrel;

a second coupling connected to a second end of the outer case and a second end of the mandrel; and a piston disposed in the annular space so as to define a first end of the annular space between the piston and the first coupling, and define a second end of the annular space between the piston and the second coupling, wherein the piston is moveable within the annular space such that movement of the piston determines whether the sleeve assembly is in the open position or the closed position, and wherein the piston is moveable by fluid such that the sleeve assembly is repeatedly switchable between the open position and the closed position;

(b) sending an electrical signal from a surface location outside the wellbore to one of the fracturing devices by a tubing encapsulated conductor so as to move the fracturing device to an operable mode to thus actuate the fracturing device, wherein in the operable mode a hydraulic circuit is completed for the fracturing device;

(c) opening the actuated fracturing device by introducing fluid to a first ported fitting which is in fluid flow communication with the first end of the annular space through a first plurality of passageways defined on a surface of the first coupling, wherein the introducing of fluid results in fluid leaving the second end of the annular space through a second plurality of passageways defined on a surface of the second coupling and a second ported fitting which is in fluid flow communication with the second plurality of passageways;

(d) fracturing the zone adjacent to the actuated fracturing device, the fracturing occurring by pumping fracturing fluid through the first fracturing device;

(e) closing the actuated fracturing device after fracturing fluid is pumped into the first zone by introducing fluid into the second end of the annular space through the second ported fitting and the second plurality of passageways, wherein the introducing of fluid into the second end results in fluid leaving the first end of the annular space through the first plurality of passageways and the first ported fitting; and (f) repeating steps (a)-(d) for at least one additional of the fracturing devices.

16. The method of claim 15, wherein the sending step comprises sending a unique electrical signal to actuate use of each fracturing device independent of the other of the fracturing devices.

17. The method of claim 15, further comprising cementing the fracturing devices in the well prior to the opening step.

18. The method of claim 15, further comprising, for the fracturing device that is opened in step (b):

deactivating the fracturing device between the opening and fracturing steps;

reactivating the fracturing device after the fracturing step and before the closing step; and deactivating the fracturing device after the closing step.

19. The method of claim 18, further comprising, after steps (a)-(f) have been performed for a desired number of the plurality of fracturing devices, reactivating selected of the fracturing devices, opening the selected of the fracturing devices to allow formation fluid to enter the fracturing devices, and communicate formation fluid to the surface.

20. The method of claim 18, further comprising selectively opening a portion of the fracturing devices, to communicate fluid from the zones adjacent the selected fracturing devices into the tubing.

21. The method of claim 15, further comprising determining whether a fracturing device has been moved to the operable mode by detecting an increase in current.

* * * * *